US009957593B2

(12) United States Patent
Cockeram

(10) Patent No.: US 9,957,593 B2
(45) Date of Patent: May 1, 2018

(54) DUCTILE METAL ALLOYS, METHOD FOR MAKING DUCTILE METAL ALLOYS

(71) Applicant: United States Department of Energy, Washington, DC (US)

(72) Inventor: Brian V. Cockeram, North Huntingdon, PA (US)

(73) Assignee: U.S. Department of Energy, Washington, DC (US)

( * ) Notice: Subject to any disclaimer, the term of this patent is extended or adjusted under 35 U.S.C. 154(b) by 347 days.

(21) Appl. No.: 14/191,691

(22) Filed: Feb. 27, 2014

(65) Prior Publication Data

US 2014/0363331 A1 Dec. 11, 2014

Related U.S. Application Data

(60) Provisional application No. 61/851,564, filed on Feb. 28, 2013.

(51) Int. Cl.

| | |
|---|---|
| ***C22C 27/04*** | (2006.01) |
| ***C22C 27/00*** | (2006.01) |
| ***C22C 1/02*** | (2006.01) |
| ***C22F 1/18*** | (2006.01) |
| ***C22C 27/02*** | (2006.01) |
| ***C22C 1/03*** | (2006.01) |

(52) U.S. Cl.

CPC ..... *C22C 27/04* (2013.01); *C22C 1/02* (2013.01); *C22C 1/03* (2013.01); *C22C 27/02* (2013.01); *C22F 1/18* (2013.01)

(58) Field of Classification Search

CPC .... C22C 1/02; C22C 1/04; C22C 1/06; C22C 27/00; C22C 27/02; C22C 27/04; C22C 27/06; C22F 1/18; C22F 1/183; C22F 1/186

See application file for complete search history.

(56) References Cited

PUBLICATIONS

Wesemann, I., A. Hoffmann, T. Mrotzek, and U. Martin. "Investigation of Solid Solution Hardening in Molybdenum Alloys." International Journal of Refractory Metals and Hard Materials 28.6 (2010): 709-15.*

"Purity of Molybdenum." Guaranteed Purity. Plansee SE. Accessed through <https://web.archive.org/web/20120410000327/http://www.plansee.com/en/839.htm>. Cache date: Apr. 10, 2012. Accessed Oct. 12, 2015.*

Totten, George E., and D. Scott. MacKenzie. Handbook of Aluminum. vol. 1. New York: CRC, 2003. 7.*

M. Semchyshen and R.Q. Barr, "Research on New Methods for Improving the Ductility of Molybdenum," J. of the Less-Common Metals, vol. 11 (1966) pp. 1-13.

(Continued)

*Primary Examiner* — Colleen P Dunn
*Assistant Examiner* — Anthony M Liang
(74) *Attorney, Agent, or Firm* — Robert T. Burns; Karen L. Blouin; Brian J. Lally

(57) ABSTRACT

A ductile alloy is provided comprising molybdenum, chromium and aluminum, wherein the alloy has a ductile to brittle transition temperature of about 300 C after radiation exposure. The invention also provides a method for producing a ductile alloy, the method comprising purifying a base metal defining a lattice; and combining the base metal with chromium and aluminum, whereas the weight percent of chromium is sufficient to provide solute sites within the lattice for point defect annihilation.

12 Claims, 5 Drawing Sheets

(56) References Cited

PUBLICATIONS

M. Semchyshen and R.Q. Barr, "Arc-Cast Molybdenum-Base Alloys," Climax Molybdenum Company of Michigan, Contract No. N8onr-78,700, Summary Report, 1955.
L.E. Olds and G.W.P. Rengstorff, "Effect of Small Amounts of Alloying Elements on the Ductility of Cast Molybdenum," Journal of Metals, (Apr. 1957), pp. 468-471.
J. Wadsworth and J.P. Wittenauer, "The History of Development of Molybdenum Alloys for Structural Applications," Evolution of Refractory Metals and Alloys, E.N.C. Dalder, T. Grobstein, and C.S. Olsen, TM, Warrendale, PA, 1994, pp. 85-108.
W.D Klopp, "A Review of Chromium, Molybdenum, and Niobium Alloys," J. of the Less-Common Metals, vol. 42 (1975) pp. 261-278.
A. Hasegawa et al., "Influence of Heat Treatment on Tensile Behavior of Neutron Irradiated Molybdenum," Journal of Nuclear Materials, vol. 233-237 (1996), pp. 565-569.
J.R. Stephens and W.R. Witzke, "Alloy Hardening and Softening in Binary Molybdenum Alloys as Related to Electron Concentration," J. of the Less-Common Metals, vol. 29 (1972) pp. 371-382.
J.R. Stephens and W.R. Witzke, "The Role of Electron Concentration in Softening and Hardening of Ternary Molybdenum Alloys," J. of the Less-Common Metals, vol. 41 (1975) pp. 265-282.
K.S. Lee and S. Morozumi, "Effects of Alloying Elements on the Workability and Ductility of Interstitial-Free Molybdenum," Trans. of Japan Institute of Metals, vol. 25, (1984), pp. 401-410.
R.Q. Barr, H. Braun, and M. Semchyshen, "Recent Developments in the Technology of Arc-Cast Molybdenum," Proc. 5th Int. Plansee Seminar, F. Benesovsky Ed., Metallwerk Plansee, Reutte, Austria, 1965, pp. 351-371.
E. Kalns, R.Q. Barr, and M. Semchyshen, "Effect of In-Process Solution Heat Treatments on the Properties of the TZM Alloy," Proc. High Temperature Refractory Metals Pt 2, 1964, pp. 375-390.
Refractory Metal Sheet Rolling Panel, "Evaluation of Test Methods for Refractory Metal Sheet Material", Materials Advisory Board, National Academy of Sciences—National Research Council, MAB-216-M, Nov. 1965.
C.B. Geller, et al., "A Computational Search for Ductilizing Additives to Mo," Wimmer Scripta Mater., 52 (2005), pp. 205-210.
J.L. Fan, et al., "Effect of Alloying Elements Ti, Zr on the Property and Microstructure of Molybdenum," Int. J. Refract. Met. Hard Mater., 27 (2009), pp. 78-82.
"Purity of Molybdenum." Guaranteed Purity. Plansee SE. Accessed through <https://web.archive.org/web/20120410000327/http://www.plansee.com/en/839.htm.>. Cache date: Apr. 10, 2012. Accessed.
Office Action and Responses for U.S. Appl. No. 14/192,068, dated Oct. 20, 2015-Oct. 28, 2016.

* cited by examiner

DUCTILE METAL ALLOYS, METHOD FOR MAKING DUCTILE METAL ALLOYS

PRIORITY

This application claims the benefit of U.S. Provisional Application No. 61/851,564 filed on Feb. 28, 2013.

CONTRACTUAL ORIGIN OF THE INVENTION

The U.S. Government has rights in this invention pursuant to U.S. Department of Energy Contract No. DE-AC11-98PN38206.

BACKGROUND OF THE INVENTION

1. Field of the Invention

This invention relates to alloys, and a method for producing alloys for use in nuclear reactors and more specifically this invention relates to alloys and a method for producing alloys having low ductile to brittle transition temperatures (DBTT).

2. Background of the Invention

Nuclear reactor environments are among the harshest on materials and substrates contained therein. There, temperatures of more than 250° C. occur. These environments also experience pressures of more than 2 psi. Irradiation fluence exposure values of more than $2\times10^{21}$ n/cm$^2$ (E>0.1 MeV) are common.

As a consequence of these harsh conditions, substrates consisting of pure elements fall short of providing robust structural forms with long lifetimes. For example, while such elements as chromium, iron, niobium, tungsten, and molybdenum have extremely low coefficients of thermal expansion and high thermal conductivity, their resistance to other aspects of a nuclear core (irradiation exposure, pressure) make them suboptimal choices. Neutron irradiation embrittlement limits the service life of materials comprising some reactor-pressure vessels in commercial nuclear-power plants.

Irradiation embrittlement results from the nucleation and growth of defect clusters, as these clusters restrict the movement of metal atom dislocations along the lattice which are needed for ductile deformation. As such, the flow stress is elevated above the inherent fracture stress of the material and brittle fracture is observed at temperatures where ductile deformation is normally seen. Defect clusters are formed by the aggregation of point defects (vacancies and self-interstitial atoms) created by the displacement of atoms from their lattice sites by collisions with high-energy neutrons during irradiation in an operating nuclear reactor. Indeed, pre-radiation exposure DBTTs (between about −100° C. and −50° C.) of some molybdenum alloys increase to more than 800° C. DBTT after exposure to irradiation fluence exposure levels typically found in reactor cores.

Reactor core environments include neutron fluence exposure values of between $2\times10^{21}$ n/cm$^2$ (E>0.1 MeV) and $1\times10^{23}$ n/cm$^2$ (E>0.1 MeV) for more than one month, and at temperatures exceeding 250° C. Therefore, elements, alloys and other substrates for use within the nuclear reactor environment must withstand high temperature, high pressure and high irradiation exposure. However, the resistance to these harsh conditions is often short lived. For example, while commercially available unalloyed molybdenum and commercially available TZM Mo-alloy exhibit DBTTs of between −50 and −100° C., irradiation results in a constant upward shift in the DBTT. Alloys such as Mo—Cr exhibit DBTTs of more than 800° C. after irradiation.

Chromium was thought to be a desirable dopant to molybdenum substrates, inasmuch as it is greatly undersized with respect to molybdenum (1.18 A for Cr versus 1.30 A for Mo), and inasmuch as the mobility of chromium is comparable to or faster than the point defects produced by irradiation. Stress fields created by Cr solute atoms serve as pinning sites. These sites pin or slow down point defects that block the movement of dislocations. The inability of dislocations to glide through the microstructure of the alloy causes increased brittleness.

However, the ductility of Mo—Cr alloys has been reported to be poor when the chromium content is greater than 0.1 percent. Specifically, Mo—Cr alloys with chromium contents greater than 0.1 percent have been reported to have a DBTT of between about −129° C. and room temperature, which is too high to be useful in advanced reactor designs.

A need exists in the art for an alloy with pre-irradiation ductile-to-brittle transition temperatures no higher than −50° C. The alloy should be comprised of high levels of chromium (i.e., greater than 0.1 weight percent) but without the heretofore concomitant embrittlement associated therewith after irradiation.

SUMMARY OF INVENTION

An object of the present invention is to provide an alloy for use in nuclear reactors that overcomes many of the disadvantages of the prior art.

Another object of the present invention is to provide an alloy to withstand harsh nuclear reactor environments. A feature of the invention is that the alloy, comprises a base metal with a thermal expansion coefficient of less than $8\times10^{-6}$ K$^{-1}$ at 20° C. and has a chromium content of between approximately 0.1 weight percent and approximately 0.9 weight percent. An advantage of the invention is that the alloy has a DBTT of approximately 300° C. to 700° C. after irradiation at 300° C. to neutron fluence exposure values between $2.2\times10^{21}$ n/cm$^2$ to $9.1\times10^{21}$ n/cm$^2$ (E>0.1 MeV).

Yet another object of the present invention is to provide a method for producing molybdenum alloys for long term use in nuclear reactor cores. A feature of the method is the incorporation of solid-solution chromium into the molybdenum BCC lattice. An advantage of the method is that a solid solution of chromium in molybdenum is formed while keeping concentrations low enough (about 9 weight percent or less) so that the formation of secondary chromium-rich phases that lead to embrittlement is simultaneously avoided.

Still another object of the present invention is to provide a method for producing an alloy that resists irradiation embrittlement when exposed to nuclear reactor environments. A feature of the invention is the use of secondary melting, extrusion, and rolling processes during alloy fabrication. An advantage of the method is that the melting processes, along with the additions of chromium and aluminum, help remove interstitial impurities from the base metal during alloy fabrication, therefore minimizing the formation of lattice anomalies which otherwise cause higher DBTT.

Another object of the present invention is to provide a method for creating molybdenum alloys with increased ductility, even after irradiation. Features of the invention include binding or otherwise sequestering oxygen solutes as oxides, and nitrogen solutes as nitrides, by the addition of chromium and aluminum, and purifying the molybdenum base metal (prior to alloying) by annealing the feedstock in a reducing atmosphere (e.g. hydrogen). An advantage of the two step method is that first, purification of the starting molybdenum reduces the initial level of the aforementioned interstitial impurities (carbon, nitrogen and oxygen), and second, the added chromium and aluminum atoms convert the remaining impurities to nitrides and oxides. The inventors found that the first step, which minimizes the presence of the impurities on the base metal lattice provides a means for enabling higher loading of chromium atoms onto the lattice.

Briefly, the invention provides a ductile alloy comprising of a transition metal (e.g., molybdenum), chromium and aluminum, wherein the alloy has a ductile to brittle transition temperature of −194° C. to −150° C. prior to irradiation exposure and about 300° C. to 700° C. after an irradiation exposure at 300° C. to neutron fluence exposure values between $2.2\times10^{21}$ n/cm$^2$ to $9.1\times10^{21}$ n/cm$^2$ (E>0.1 MeV).

The invention also provides a method for producing a ductile alloy, the method comprising purifying a base metal defining a BCC lattice; and combining the base metal with chromium and aluminum, wherein the chromium and aluminum are present in an amount to establish solid solution of the chromium and the aluminum in the lattice.

The invention further provides an alloy comprising molybdenum, chromium, and aluminum, wherein the chromium and aluminum are present as dispersed atoms substantially in solid solution.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figure 1:
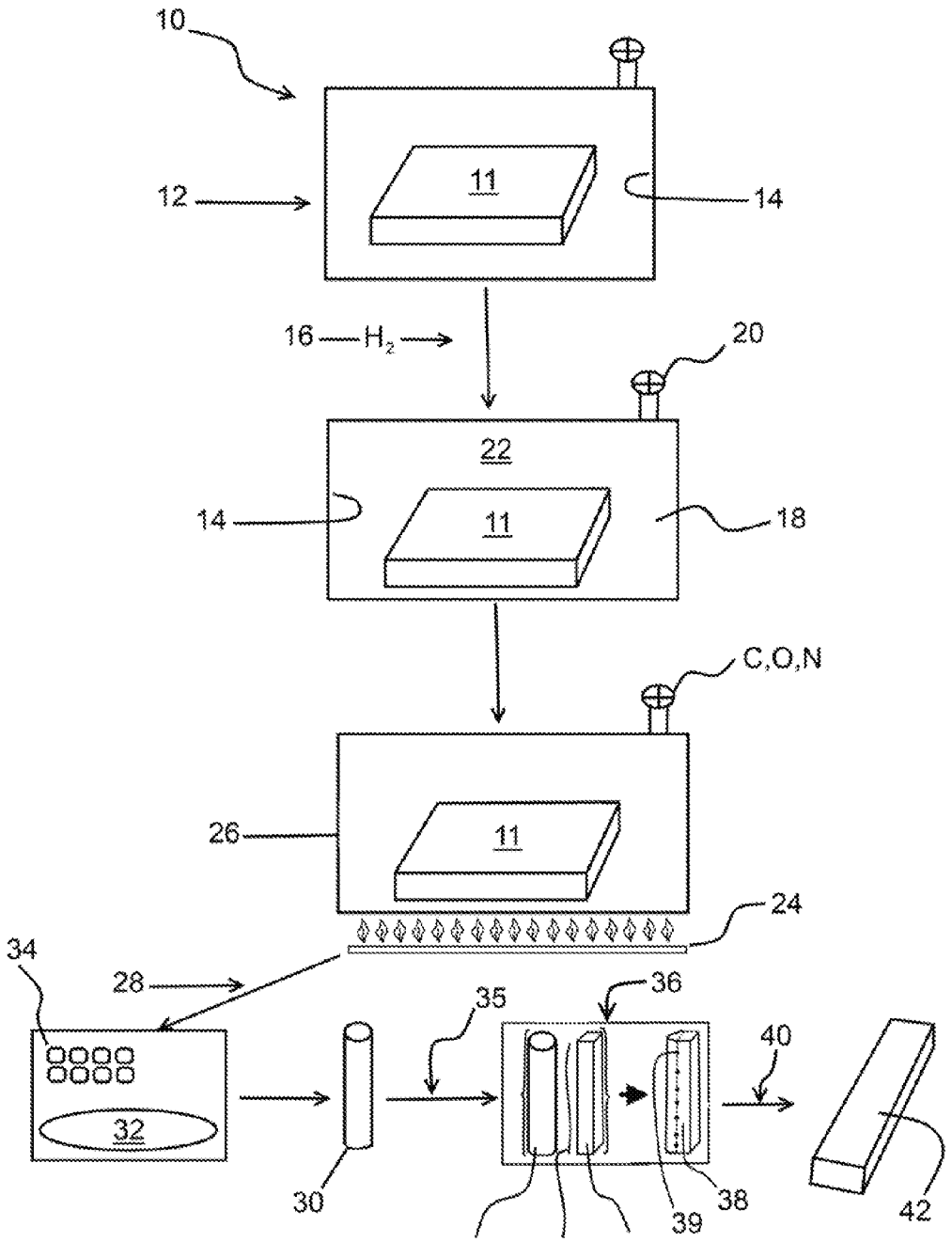
FIG. 1 is a schematic depiction of a method for producing highly ductile alloys, in accordance with features of the present invention.

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Generally, the invention provides a highly ductile substrate for use in advanced nuclear reactor environments. The invention also provides a method for producing the ductile substrate. A salient feature of the method is that it is a two-step process whereby the bulk starting material, such as transition metals, such as molybdenum and tungsten, are first purified to remove solute impurities, then, the metal is alloyed with impurity solute getters (e.g., chromium and aluminum) to scavenge the remaining impurities in the lattice of the starting material. Such impurities include displaced oxygen, nitrogen and carbon atoms. Free oxygen atoms increase brittleness because they serve to reduce the fracture resistance of the base metal.

In an embodiment of the invention, the addition of chromium at concentration levels between about 0.1 weight percent and about 0.9 weight percent provides a higher concentration of undersized solute atoms that serve as recombination centers for point defects during irradiation. This higher concentration of undersized solute atoms mitigates irradiation embrittlement.

Preferably, the base metal is a transition metal or a BCC metal, has a yield strength of more than 50 ksi at room temperature, and linear thermal expansion coefficient of no more than $8\times10^{-6}$ K$^{-1}$ at 20° C. Preferably, the mobile solid phase should comprise an atom which is relatively smaller than the transition metal atom. These relatively smaller atoms serve as recombination centers for point defects during irradiation of the alloy in two ways. First, the smaller size of the atom creates strain on the lattice because of the size mismatch between the mobile phase atom and transition metal atom. This strain slows down the migration of defects so that their recombination is enhanced and the concentration of point defects is reduced, decreasing the concentration of voids produced by irradiation. Second, the mobile phase atoms migrate to defects in the lattice and pin them long enough for recombination to occur.

The mobile solid phase and another getter, in this case chromium and aluminum, respectively, form compounds with interstitial contaminants, such as nitrogen, oxygen, and carbon. These contaminants are ubiquitous during metal purification processes. In forming compounds with the interstitial contaminants, the mobile solid phase and second getter serve to bind, sequester, or otherwise remove the ubiquitous contaminants. The formed compounds embrittle the alloy far less than the free interstitial contaminants otherwise would.

The purification step of the invented method allows for the existence of higher concentrations (e.g., higher than 0.1 weight percent) of chromium atoms in the bulk alloy metal. These higher levels (between about 0.1 and about 0.9 percent) of chromium in the invented alloy provide a higher fraction of solute sites for point defect annihilation. The higher percentages of chromium also provide solid-solution strengthening that improves the tensile strength by 10 percent to 50 percent relative to prior art alloys. Generally, solid solutions are mixtures of substances in solid form. Solid solutions often comprise two or more types of atoms or molecules that share a crystal lattice. In such crystal structure scenarios, there is a substitution of one kind of atom, ion, or molecule for another that is chemically different but similar in size and shape.

Alloying molybdenum with chromium in the composition range where a solid-solution is formed (Cr content<0.9 percent) provides a misfitting atom in the Mo BCC lattice that creates local stress fields, which affects the diffusion of interstitials and vacancies liberated via neuron collisions and suppresses the formation of the voids and loops that otherwise facilitate irradiation embrittlement. Also, surprisingly and unexpectedly, the inventors found that purification of the starting molybdenum stock is important for two reasons: 1) the initial levels of solutes, such as oxygen, nitrogen, and carbon, are reduced, and 2) the number density of small oxide or nitride particles formed by the gettering of these elements with aluminum and chromium is lower. As such, the invented fabrication method minimizes both the existence of oxygen and nitrogen solutes and further forms inclusions with the remaining solutes, both of which served to minimize residual embrittlement effects.

An embodiment of the invention provides a base metal-Cr alloy comprised of a base metal and having a composition of between about 0.1 weight percent and about 0.9 weight percent chromium (preferably between about 0.4 and about 0.9 percent), and between about 0.001 weight percent (10 ppm) to about 0.05 weight percent (500 ppm) aluminum. The base metal is molybdenum, tungsten, niobium, tantalum, or combinations thereof. In an embodiment, the comprises less than about 20 ppm oxygen and less than about 20 ppm carbon. In another embodiment, the alloy comprises aluminum oxides, and in a further embodiment, the alloy of comprises less than about 15 ppm nitrogen.

Another embodiment of the invention provides a molybdenum-chromium-aluminum alloy having a composition of between about 0.1 weight percent and about 0.9 weight percent chromium (preferably between about 0.4 and about 0.9 percent), and between about 0.001 weight percent (10 ppm) to about 0.05 weight percent (500 ppm) aluminum. The addition of aluminum and the low starting interstitial content achieved by purification of the molybdenum used for these alloys results in a DBTT for these Mo—Cr—Al alloys that is lower than any Mo—Cr alloy reported to date that has a chromium content greater than 0.1 percent.

The invented Mo—Cr—Al alloys contain a higher chromium content than any Mo—Cr alloy reported to date (wherein the chromium is contained in solid-solution). As such, any concentration of the chromium solute which results in it being present as a solid solute is a suitable concentration. The chromium atoms are capable of moving to point defects (and vice versa such that the defects gravitate toward the chromium atoms). This phenomenon traps the defects and/or enhances their recombination to reduce the number of defects. Having chromium solutes present as mobile atoms also allows them to tie up interstitial atoms, such as oxygen and nitrogen, that may also be displaced during irradiation to reduce the embrittling effect of those atoms.

The alloys disclosed comprise at least a base metal and chromium within the limits disclosed, where the base metal has a body-centered cubic (BCC) crystal structure, and where the base metal and the chromium form a solid solution. In an embodiment, the base metal is molybdenum, tungsten, niobium, tantalum, or combinations thereof. In a particular embodiment, the base metal is molybdenum.

Here, "solid solution" means a mixture of a base metal and chromium, where the base metal is the solvent and the chromium is the solute, and where the solid solution has a BCC crystal structure, with base metal atoms present at a first group of lattice points in the BCC crystal structure and chromium atoms present at a second group of lattice points in the BCC crystal structure. Evidence that the base metal and the chromium are in solid solution may be obtained using methods known in the art, such as x-ray diffraction (XRD) analysis. See e.g., Hahn et al., "Cr—Mo Solid Solutions Forced by High-Energy Ball Milling," *Metall. Mater. Trans. A* 35A (2004), among others. In an embodiment, when the base metal and the chromium form a solid solution, this means that when the disclosed alloy is analyzed by XRD, only an XRD peak expected for the base metal-chromium solution is detected and no XRD peaks for chromium metal are detected.

Further, the inventors found that the aluminum additions have the effect of taking oxygen and nitrogen out of solution by the formation of a second-phase particle. Specifically, the aluminum combines with oxygen to form aluminum oxide, and this oxide is less detrimental to the material than free oxygen. The chromium atoms have likewise been found to combine with oxygen to form chromium oxides, which are also less detrimental than free oxygen atoms. Use of hydrogen annealing to purify the molybdenum melt stock prior to melting in the VAR results in a lower carbon, oxygen, and nitrogen content and provides additional means for lowering DBTT. The molybdenum stock is between 0.25" to 0.4" thick and is annealed at 1600° C. for at least 72 hours.

FIG. 1 is a schematic diagram of the invented process, designated therein as numeral 10. A first step 12 of the process is placing of the alloy base metal 11, which is chosen here to be molybdenum for illustrative purposes, into an enclosure or atmosphere 14 capable of being controlled. A purification step 18 ensues whereby first a reductant 16 (such as hydrogen) is added to the enclosure so as to establish a substantially reducing atmosphere. A means of egress 20 is in fluid communication with the enclosure 14 to facilitate evacuation of the ambient atmosphere and the establishment of a substantially reducing atmosphere.

Alloy base metal 11 is comprised of the base metal and further comprised of an oxygen content and a carbon content. In an embodiment, the carbon content is present such that Alloy base metal 11 is greater than or equal to about 40 ppm carbon.

Upon establishment of the reducing atmosphere 22, where the reductant contacts substantially all exterior surfaces of the metal 11, the metal is heated to a temperature less than its melting point. A myriad of means 24 for heating the metal is suitable, including thermal conductance of heat through the enclosure via electrical coils in physical contact with an outside surface of the enclosure. A preferred temperature for the heating of molybdenum feedstock is 1600° C.

The metal is subjected to a heating step 26 at a specific temperature and for specific time suitable to drive contaminant solutes such as nitrogen, carbon, and oxygen from the metal down to a predetermined level. In an embodiment, the specific temperature is at least 1000° C. and the specific time is at least 48 hours. The preferred heating time for molybdenum feedstock of this thickness is 72 hours to 84 hours. Generally, these contaminant solutes evacuate the housing via the means of egress 20.

The metal is subjected to a cool down step 28 prior to being subjected to fabrication with its alloy constituents. Upon cool down, to a suitable temperature in hydrogen, the starting material can be removed from the atmosphere. The preferred cool down temperature for molybdenum alloys is between about room temperature (e.g. about 20° C.) to about 100° C. so that surface oxidation is minimized.

The next step is to form a master alloy 30 from the purified metal 11. The purified metal 11 is melted in a melting trough 32. A suitable melting trough is a water cooled copper trough, and a suitable melting means is tungsten inert gas welding, wherein a thoriated tungsten electrode is utilized. Chips 34 of the secondary constituent, in this case chromium, are deposited onto the metal 11 to produce a two metal alloy. In an embodiment, aluminum is additionally added. The chamber is then evacuated to a pressure of about $10^{-6}$ Torr and then back filled with argon prior to melting. In an embodiment, The master alloy 30 is again heat treated in a non-oxygen atmosphere. For example, master alloy 30 may be again heat treated at 1600° C. for at least 72 hours in a 100% hydrogen atmosphere.

The master alloy 30 is then physically joined with a solute getter 35 and additional purified base metal 11 in a metal joining step 36 to form an electrode 38. Preferably, the solute getter 35 is in the form of a wire and is sandwiched between the master alloy 30 and the base metal 11. The master alloy 30 and base metal 11 are then joined together, keeping the solute getter 35 in the center of the electrode 38. An exemplary joining method is to subject the metals to metal inert gas welding such as tungsten inert gas welding, whereby as the name implies, the welding atmosphere comprises an inert gas such as argon. FIG. 1 shows tack welds 39 holding the electrode 28 assembly together.

The resulting electrode 38 is then subjected to another melting step 40 such as a vacuum arc remelting process and subsequently extruded into ingots 42 of predetermined sizes.

Example

The starting stock used to produce Mo—Ti—Al alloys was Low Carbon Arc Cast (LCAC) molybdenum in either plate or rod form, which is commercially available unalloyed molybdenum with a relatively low carbon (≈40-70 ppm) and oxygen (≈20 ppm) content. Purification of the molybdenum was achieved by heat treating in a 100 percent hydrogen atmosphere at 1600° C. for a minimum of 72 hours, which generally reduces the carbon and oxygen content to levels<20 ppm and <10 ppm, respectively. As discussed supra, purification reduces the interstitial solute levels that can result in embrittlement.

Molybdenum was melted in a water-cooled copper trough. The water-cooled copper trough was chosen because of the high thermal conductivity of the copper and the ability of the flowing water to absorb the heat, thereby preventing the melting of the trough and the mixing of the metals. Chromium chips were distributed uniformly on the molybdenum melt stock. The trough chamber was evacuated and then back filled with argon. The mixture was melted using a thoriated tungsten nonconsumable electrode to form the master alloy in the shape of a rod approximately 0.5" in diameter and at least 22" in length. The master alloy rods were given an additional heat treatment at 1600° C. for 72 hours for purification. Despite the exposure to the hydrogen atmosphere, no hydrogen embrittlement was noticed to have taken place.

After purification, the Mo—Cr masteralloy rods were welded to purified molybdenum and aluminum wire to form electrodes. The welding was accomplished via Gas Tungsten Arc Welded (GTAW) in an inert (argon) glovebox to form the electrode. During this process, black deposits were formed on the surface of the electrode, which denotes chromium oxide formation and the loss of some chromium. The electrodes were melted under vacuum into ingots for Alloys 1 and 2 and into ingots for the Alloys 3 and 4. The electrodes could also be melted under an inert atmosphere (such as flowing argon gas) to reduce the loss of chromium.

Table I shows the starting and ending amounts of each alloying addition and the ingot diameter. As can be seen from Table I, the starting chromium amount must be higher than the intended final alloy amount. The changes in chromium content are easily solved and present no significant difficulty for producing the Mo—Cr—Al alloys on an industrial scale. Table I also shows that the amount of oxygen in the final alloy increases with increasing chromium content, and the higher levels of oxygen are likely the result of the higher levels of chromium addition. The higher levels of chromium are sufficient to tie up and sequester the oxygen so that embrittlement from oxygen is minimized. This is shown by the lower DBTT values of −150° C. to −196° C. observed for the Mo—Cr—Al alloys with Cr levels between 0.1 and 0.9%. Table I also shows that a larger percentage of chromium is lost during creation of the alloy as the initial chromium concentration increases. Further, Table I shows that the amount of aluminum that the alloy was able to retain decreases with increasing chromium concentration despite initially adding increased amounts of aluminum.

TABLE I

Mo—Cr—Al Alloying Additions Initial and Final Amounts

| Alloy | Initial Cr (wt %) | Initial Al (wt %) | Final Cr (wt %) | Final Al (wt %) | Interstitial Levels (ppm) carbon | oxygen | nitrogen |
|---|---|---|---|---|---|---|---|
| 1 | 0.2 | 0.05 | 0.11 | 0.011 | 13 | 13 | 4 |
| 2 | 1.0 | 0.005 | 0.15 | 0.003 | 18 | 38 | 4 |
| 3 | 2.5 | 0.005 | 0.41 | 0.002 | 17 | 68 | 9 |
| 4 | 5.0 | 0.06 | 0.90 | 0.0021 | 18 | 82 | 10 |

The ingots were then extruded (via dynapak or similar means) into a bar after heating to about 1400° C. (pre-heat in hydrogen) with a fire pressure of 1100 psi—a pressure sufficient to force the round bar through the rectangular die to form the sheet bar. The sheet bars were machined flat and used for rolling after pre-heating in hydrogen at temperatures ranging from 500° C. to 1300° C. Each rolling pass provided a 10 percent reduction in thickness. The final cold rolling was performed to produce sheet with a final thickness of about 70-75% cold work for Alloy 1, about 50-80% cold work for Alloy 2 and about 50-70% cold work for Alloys 3 and 4

Microstructures of the Mo—Cr—Al alloys produced comprise elongated, sheet-like grains. Second phase particles larger than about 1-2 microns in diameter are not present. This indicates that the alloys are solid solutions of molybdenum and chromium. In a preferred embodiment of the invention, chromium content is less than about 0.9 weight percent. Preferable chromium concentrations are taken from range of between about 0.1 weight percent and 0.9 weight percent. Table II, below, summarizes the DBTT for Alloys 1-4 in both the as worked and stress relieved conditions as determined from tensile testing.

TABLE II

DBTTs for Mo—Cr—Al Alloys based on Tensile Test Results

| Alloy | As Worked DBTT (° C.) | Stress Relieved DBTT (° C.) |
|---|---|---|
| 1 | −175 | −175 |
| 2 | −196 | −100 |
| 3 | −175 | −150 |
| 4 | −196 | −162 |

Figure 2A:
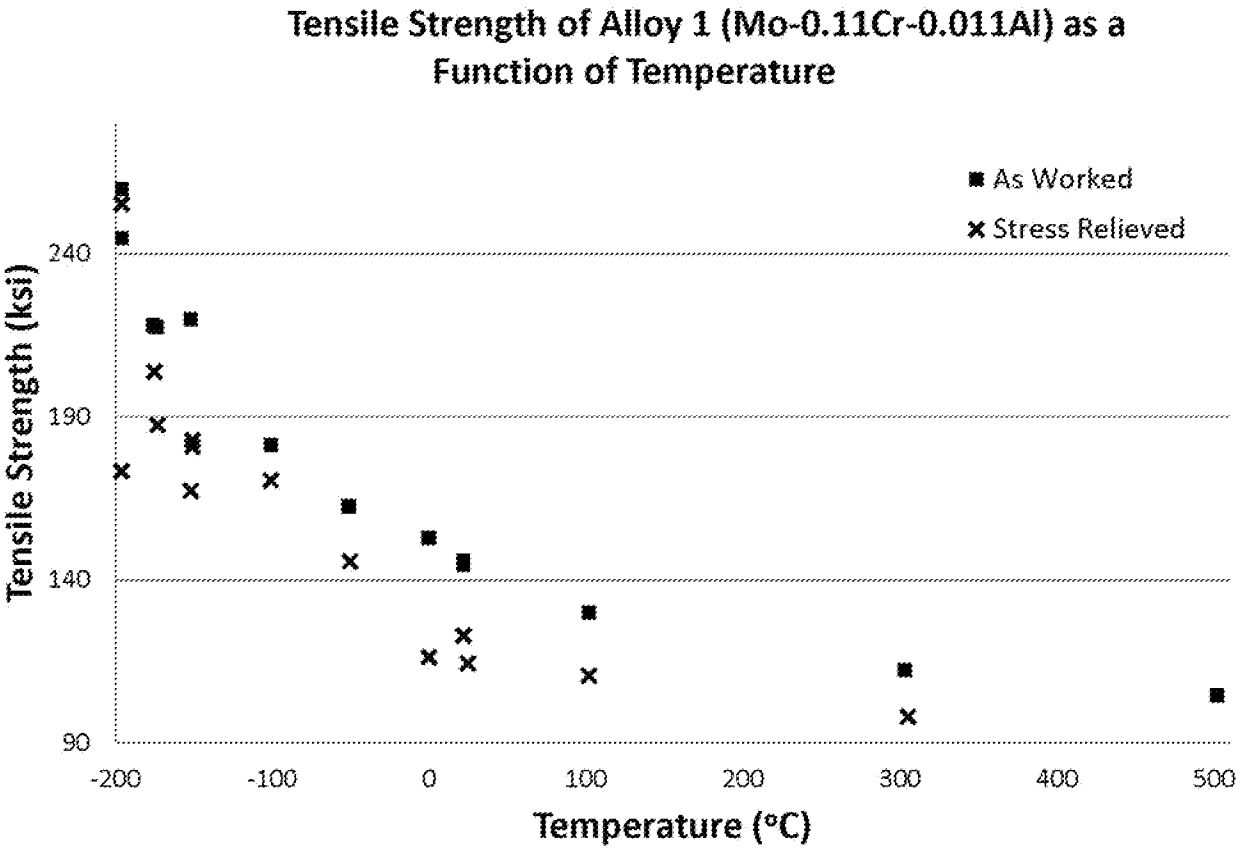
FIGS. 2A-C are graphs of the tensile properties of embodiments of the presently invented alloy.
Figure 2B:
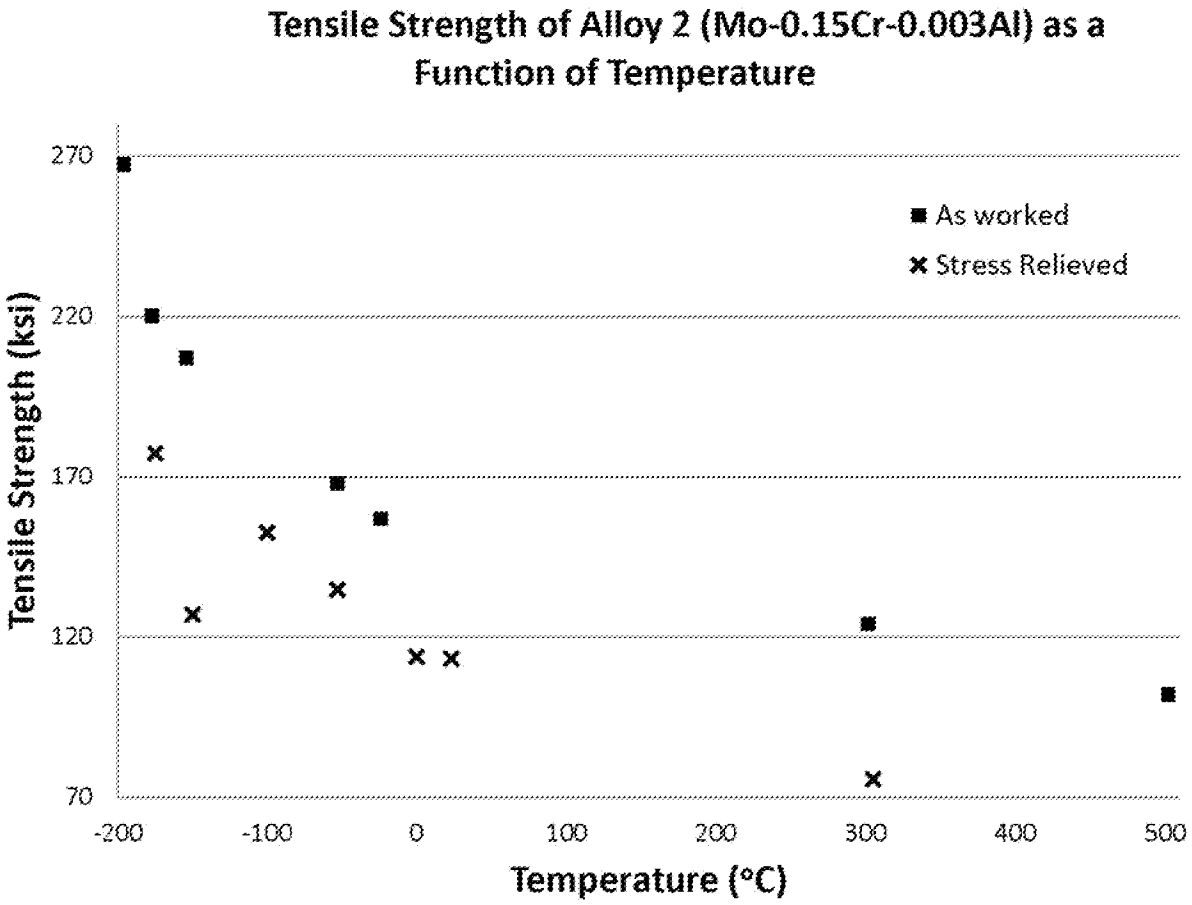
Figure 2C:
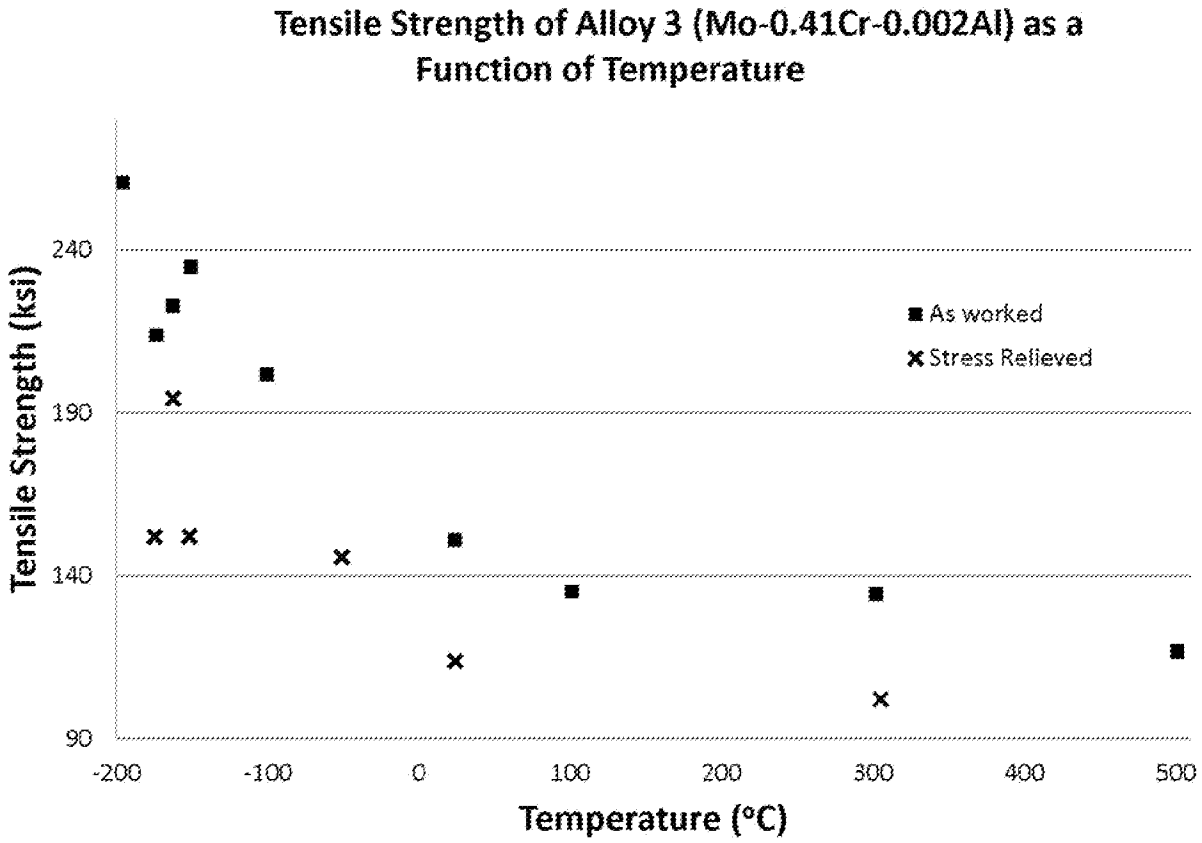

FIGS. 2A-C depict tensile properties for embodiments of the invented alloys. FIG. 2A shows the tensile properties of Alloy 1 in both the as worked and stress relieved states. FIG. 2B shows the tensile properties of Alloy 2 in the as worked and stress relieved states. FIG. 2C shows the tensile properties of Alloy 3 in the as worked and stress relieved states. As can be seen in FIGS. 2A-C, the as worked alloys have a higher tensile strength than the stress relieved alloys. This is because the as-worked condition provides a higher dislocation density. During plastic deformation, dislocation stress fields interact, which prevents dislocation motion through the crystal grains. The inability of dislocations to move requires more energy to be applied to overcome the stress field interactions, which corresponds to an increased tensile strength. A stress-relief anneal can be performed to reduce the dislocation density for some applications, such as to increase the ductility of the alloy. Depending on the time and temperature of annealing, the alloy could undergo recrystallization and grain growth. However, the stress relieved alloys as shown in FIGS. 2A-C did not undergo recrystallization.

Figure 3:
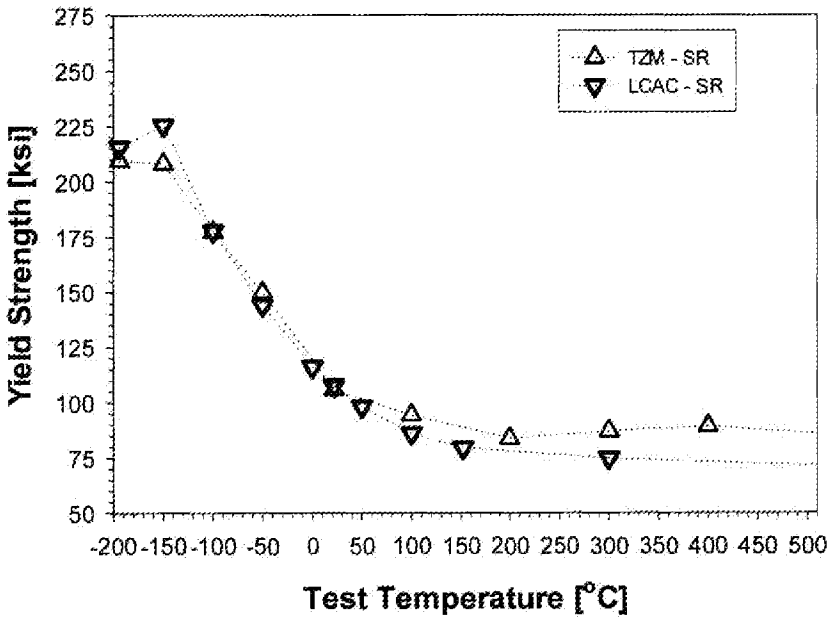
FIG. 3. is a graph of the tensile property of state of the art molybdenum alloys.

FIG. 3 shows the tensile properties for state of the art molybdenum alloys TZM and LCAC. By comparison, the invented alloys all have higher tensile strengths than state of the art TZM and LCAC. The invented alloys have a much higher tensile strength than LCAC and TZM because of the solid solution strengthening provided by the chromium additions.

Thus, the invention provides a molybdenum alloy with an increased yield strength and lower DBTT. The increased yield strength is the result of solid solution strengthening from the chromium additions. The decreased DBTT results from three factors: (1) the addition of a greatly undersized solute atom, which also serves as a getter of interstitial impurities, in the form of chromium; (2) the addition of a second getter of interstitial impurities in the form of aluminum; and (3) the purification of the molybdenum base metal through hydrogen annealing. The presently invented alloy has properties that make it useful for nuclear reactor components because the presently invented alloy is able to better withstand irradiation embrittlement.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. An alloy, consisting of:
purified molybdenum in solid solution with chromium, the purified molybdenum having less than 20 ppm carbon and 10 ppm oxygen, and further consisting of
11 ppm to 500 ppm aluminum,
less than 15 ppm nitrogen, and
0.1 wt. % to 0.9 wt. % chromium, wherein
the purified molybdenum is the solvent,
the chromium is the solute, and
the alloy has a ductile to brittle transition temperature of −194° C. to −150° C.

2. The alloy of claim 1 consisting of 0.4 wt. % to 0.9 wt. % chromium.

3. The alloy of claim 2 wherein at least a portion of the 11 ppm to 500 ppm aluminum and the less than 10 ppm oxygen are present as aluminum oxide.

4. The alloy of claim 3 consisting of less than 10 ppm nitrogen.

5. The alloy of claim 2 wherein:
at least a portion of the less than 10 ppm oxygen is present in the solid solution as a first interstitial element, and
at least a portion of the less than 20 ppm carbon is present in the solid solution as a second interstitial element.

6. The alloy of claim 5 further consisting of:
less than 10 ppm nitrogen, wherein
at least a portion of the less than 10 ppm nitrogen is present in the solid solution as a third interstitial element.

7. The alloy of claim 1, wherein:
the solid solution has a body-centered cubic (BCC) structure,
the BCC structure comprises lattice points,
a plurality of solvent molybdenum atoms are present at a first group of lattice points, and
a plurality of solute chromium atoms are present at a second group of lattice points.

8. The Mo—Cr alloy of claim 7, wherein:

at least a portion of the less than about 10 ppm oxygen is present in the solid solution as a first interstitial element, at least a portion of the less than about 20 ppm carbon is present in the solid solution as a second interstitial element, and at least a portion of the less than about 10 ppm nitrogen is present in the solid solution as a third interstitial element.

9. A method of forming an alloy, comprising:

purifying molybdenum by heat treating the molybdenum in a reducing atmosphere until the purified molybdenum consists of less than 20 ppm carbon, less than 10 ppm oxygen, and less than 15 ppm nitrogen;

adding between 11 ppm and 500 ppm aluminum to the purified molybdenum; and forming an alloy of the purified molybdenum, the aluminum, and between 0.1% wt and 0.9% wt chromium, wherein:

the purified molybdenum is in solid solution with the chromium, the purified molybdenum is the solvent, the chromium is the solute, and the alloy has a ductile to brittle transition temperature of −194° C. to −150° C.

10. The method of claim 9, further comprising heat treating the molybdenum in a hydrogen atmosphere at a temperature of at least 1000° C. for at least 48 hours.

11. The method of claim 10 further comprising exposing the molybdenum to a second reducing atmosphere.

12. The method of claim 11, further comprising heat treating the molybdenum at a temperature of at least 1000° C. for at least 48 hours.

* * * * *